US005833352A

United States Patent [19]

Goodwin

[11] Patent Number: 5,833,352

[45] **Date of Patent: *Nov. 10, 1998**

[54] BRIEFCASE LIGHT

[76] Inventor: Faith M. Goodwin, 195 S. Carolina Ave., Spartanburg, S.C. 29306

[ * ] Notice: The terminal 25 months of this patent has been disclaimed.

[21] Appl. No.: 264,691

[22] Filed: Jun. 23, 1994

[51] Int. Cl.[6] ..... A45C 15/06

[52] U.S. Cl. ..... 362/156; 362/154; 362/287

[58] Field of Search ..... 362/154, 156, 362/191, 106, 190, 155, 287

[56] References Cited

U.S. PATENT DOCUMENTS

| | | | |
|---|---|---|---|
| 1,432,297 | 10/1922 | Metternich | 362/156 |
| 2,179,214 | 11/1939 | Hallbauer | 362/156 |
| 4,002,895 | 1/1977 | Ketler et al. | 362/106 |
| 4,974,128 | 11/1990 | Prickett | 362/806 |
| 5,333,408 | 8/1994 | Simmons | 362/154 |

FOREIGN PATENT DOCUMENTS

| | | | |
|---|---|---|---|
| 140259 | 4/1902 | Germany | 362/156 |
| 883546 | 11/1961 | United Kingdom | 362/156 |

*Primary Examiner*—Ira S. Lazarus
*Assistant Examiner*—Y. Quach
*Attorney, Agent, or Firm*—David L. Baker; Henry S. Miller

[57] ABSTRACT

A briefcase light is provided that consists of a base unit, a flexible arm and a light/power source unit. The light/power source unit contains a light emitting device, a battery and a switch, all electrically connected. The flexible arm allows the user to direct the light provided in any direction without the need for the user to hold the light in place.

3 Claims, 1 Drawing Sheet

FIG. 1
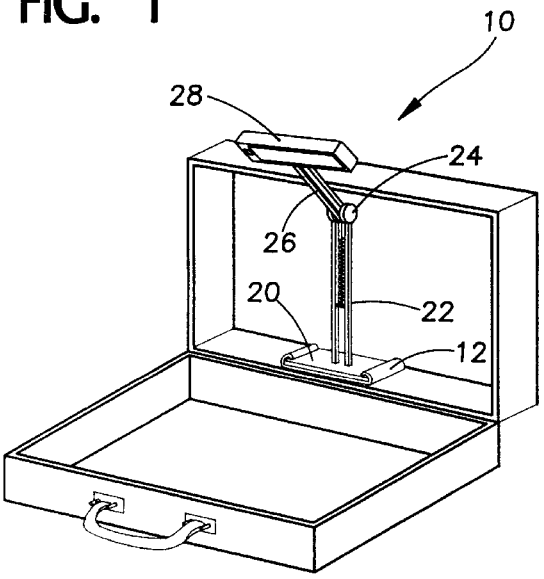
FIG. 2
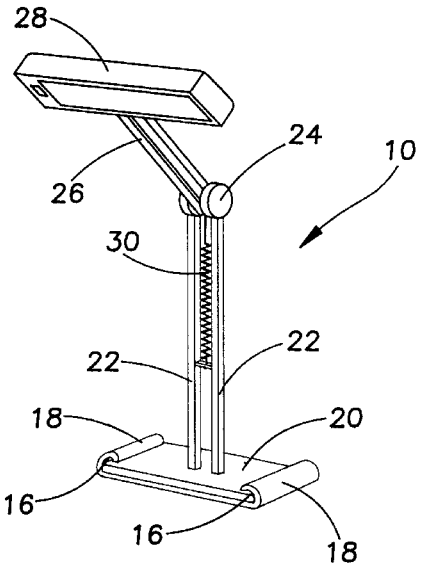
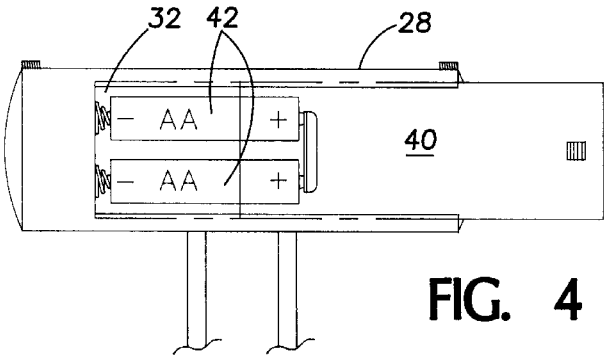
FIG. 4
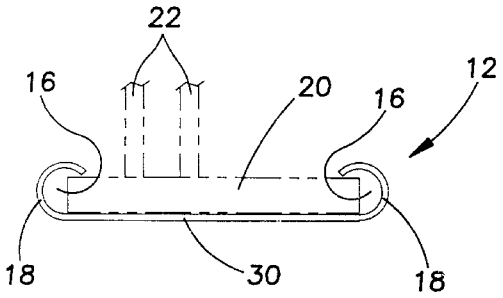
FIG. 3
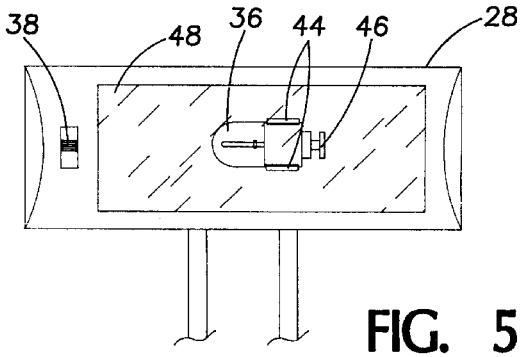
FIG. 5

BRIEFCASE LIGHT

BACKGROUND OF THE INVENTION

1. Field of Invention

This invention relates generally to the field of illumination devices and more specifically to devices for illuminating the contents of articles of luggage such as briefcases.

2. Background of Invention

Briefcases used by many workers may have separate compartments for holding diverse items. These compartments may vary in size, style and orientation, depending on the manufacture of the briefcase. In situations of inadequate external lighting, the user of a briefcase will have a need for additional illumination to sort through the various objects in the briefcase to locate a specific item. In addition, the briefcase may need to serve as a portable desk. For these reasons, a device for illuminating the contents of a briefcase must be able to illuminate a wide area and the device would also need to be adjustable to illuminate the desired work space.

Numerous devices have been provided for illuminating the contents of items of luggage such as purses and pocketbooks, providing the user the ability to find a desired item within such purse. While some have provided for the device to be removed from the purse, none of the previous devices have provided the benefits that the present invention provides. Lyle U.S. Pat. No. 4,912,611 discloses a cylindrical purse light that may be removed and directed by the user and whose switch is automatically closed when the purse is opened. Knight U.S. Pat. No. 4,654,763 discloses a pocketbook light whose double activating switch requires two separate contacts, preventing accidental illumination of the light. Biggs, et. al. U.S. Pat. No. 5,018,057 discloses a touch initiated light module with a touch sensor that must be touched twice in order for the control circuitry to close the electric light circuit, also for preventing accidental illumination of the light. Ohrenstein, et. al. U.S. Pat. No. 4,091,443 discloses a multipurpose light with a mirror that has two separate light sources and a three position switch that selects which light will be lit. Kidder, et. al. U.S. Pat. No. 4,954,934 discloses a purse light with a domed lens.

Although these devices allow the user to remove the device from the purse or other piece of luggage, these devices require the user to hold the device once it has been removed from the luggage. The present invention provides an adjustable free-standing device for illuminating a desired area.

SUMMARY OF THE INVENTION

The briefcase light is constructed from a base unit having a base plate and a sliding plate that is removably attached to the briefcase, a flexible arm assembly, a light emitting device, a battery compartment, a battery, a switch and the necessary wiring. The light emitting device, battery, battery compartment and switch reside in one unit to prevent excess wiring and unnecessary complicity, and can utilize any of a variety of commonly available batteries.

It is therefore an object of the present invention to provide a new and improved device for illuminating the contents of a briefcase.

It is another object of the invention to provide a flexible light for use with a briefcase that will allow for improved working conditions.

It is a further object of the present invention to provide a lighting device that may be readily attached to a briefcase or removed and thereafter be steady and free-standing.

It is still another object of the invention to provide a lighting device for luggage that is adjustable.

It is still a further object of the invention to provide a luggage lighting device that may be easily and efficiently manufactured and marketed.

It is another object of the invention to provide a lighting device that is low in cost and simple to operate.

These and other advantages, features and objects of the invention will become more apparent from the following description taken in connection with the illustrative embodiment in the accompanying drawings.

DESCRIPTION OF THE DRAWINGS

FIG. 1 is perspective view of the invention in a briefcase.

FIG. 2 is a perspective view of the invention.

FIG. 3 is an end view of the base plate of the invention.

FIG. 4 is a rear view of the light/power source unit of the invention, showing the battery compartment partially opened.

FIG. 5 is a front view of the light/power source unit of the invention.

DESCRIPTION OF A PREFERRED EMBODIMENT

In the preferred embodiment, as shown in FIGS. 1 and 2 of the drawings, the invention is shown generally at 10, a permanent base plate 12 is attached inside briefcase 14. Permanent base plate 12 has channels 16 formed by curving up two opposing sides 18 of the base plate. Compatible plate 20 has a snug siding fit into channels 16. Lower parallel support arms 22 are attached at one end to sliding plate 20 and at the other end to hinge 24. Upper singular support arm 26 is attached at one end to hinge 24 and at the other end to light/power source unit 28. Spring 30 may be connected alternatively between either lower arms 22 or upper arm 26, or to both arms and plate 20 to control the range of motion and flexibility of the arm assembly.

Concerning FIG. 3, the permanent base plate 12 has a planar surface 30, with opposed sides 18 rolled into a arcuate channel 16 adapted and sized to provide a snug sliding fit for plate 20 which supports lower parallel support arms 22.

FIGS. 4 and 5 disclose the lighting unit of the invention where battery compartment 32 is contained within light/power source unit 28 and opens on the rear side of the light/power source unit. The battery compartment is electrically connected to light emitting member 36 via switch 38. Battery compartment cover 40 serves to retain the batteries 42 inside the battery compartment and to protect the electric wiring within the battery compartment. While the drawing shows the battery compartment cover as a sliding panel, any variety of door or panel may be used within the scope of the invention.

The light emitting member 36 is contained within the light/power source unit 28 and is held in place by light bulb clamps 44 and light bulb base contact 46. In addition to retaining the light emitting member, the light bulb clamps and light bulb base contact provide the electrical connection between the light emitting member 36, battery compartment 32 and switch 38. Protective lens 48, made of a transparent or translucent material, covers the light emitting member and is attached to the light/power source unit. The protective lens may be designed to direct the light provided by the light emitting member and may be of any shape or configuration.

Switch 38 is located within the light/power source unit completing the electric circuit between the battery compartment and the light emitting member. The switch may protrude anywhere on the light/power source unit that is comfortable for the user.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A device for illuminating an interior of a briefcase, comprising:

(a) a base unit;

(b) means for attaching the base unit to an inside of the briefcase, said base unit comprising:

a base plate having a planar surface and opposing sides each upwardly rolled into an arcuate channel, the base plate attached to the inside of the briefcase; and a sliding plate removably and slidingly engaged at both ends with the arcuate channels of the base plate;

(c) a flexible arm with two ends, removably attached at one end to the sliding plate;

(d) a light/power source unit attached to another end of the flexible arm;

(e) a light emitting member housed within the light/power source unit;

(f) a battery source housed within the light/power source unit, electrically connected to the light emitting member; and (g) a switch electrically connected to the light emitting member and to the battery source whereby said light emitting member illuminates the interior of the briefcase.

2. A device for illuminating the interior of a briefcase as described in claim 1, further comprising:

(a) a protective lens located over the light emitting member.

3. A device for illuminating the interior of a briefcase as described in claim 1, where the flexible arm comprises:

(a) a plurality of support arms; and (b) at least one flexible hinge connecting the rigid arms to each other and to the light/power source unit.

* * * * *